United States Patent [19]

Strehler et al.

[11] 4,446,089

[45] May 1, 1984

[54] PROCESS AND APPARATUS FOR THE PRODUCTION OF PLASTIC STRANDS

[75] Inventors: Hugo Strehler, Frankenthal; Guenter Valentin; Werner Hoerauf, both of Ludwigshafen, all of Fed. Rep. of Germany

[73] Assignee: BASF Aktiengesellschaft, Fed. Rep. of Germany

[21] Appl. No.: 461,744

[22] Filed: Jan. 28, 1983

[30] Foreign Application Priority Data

Feb. 17, 1982 [DE] Fed. Rep. of Germany ..... 3205645

[51] Int. Cl.[3] ..... D01D 5/08

[52] U.S. Cl. ..... 264/178 F; 425/71

[58] Field of Search ..... 264/178 F; 425/67-71

[56] References Cited

U.S. PATENT DOCUMENTS

| | | | |
|---|---|---|---|
| 2,875,019 | 2/1959 | Spohn et al. | 264/176 F |
| 3,199,148 | 8/1965 | Koppehele | 425/71 |
| 3,491,177 | 1/1970 | Johnson | 264/178 F |
| 3,609,805 | 10/1971 | Fritsch | 425/71 |
| 3,890,074 | 6/1975 | Fritsch | 425/71 |
| 4,321,230 | 3/1982 | Haugerford | 425/71 |

*Primary Examiner*—Jay H. Woo

*Attorney, Agent, or Firm*—Keil & Witherspoon

[57] ABSTRACT

A melt of synthetic material is forced through orifices of a die plate, and the resulting strands of melt are led into a trough, where they travel in counter-current to a stream of cooling water. At the end of the trough, the strands are discharged, for further processing. The bottom of the trough merges into a vertical pipe and the melt strands are led into this pipe and out again, in a variable loop, in order to obtain the desired length of cooling path.

7 Claims, 1 Drawing Figure

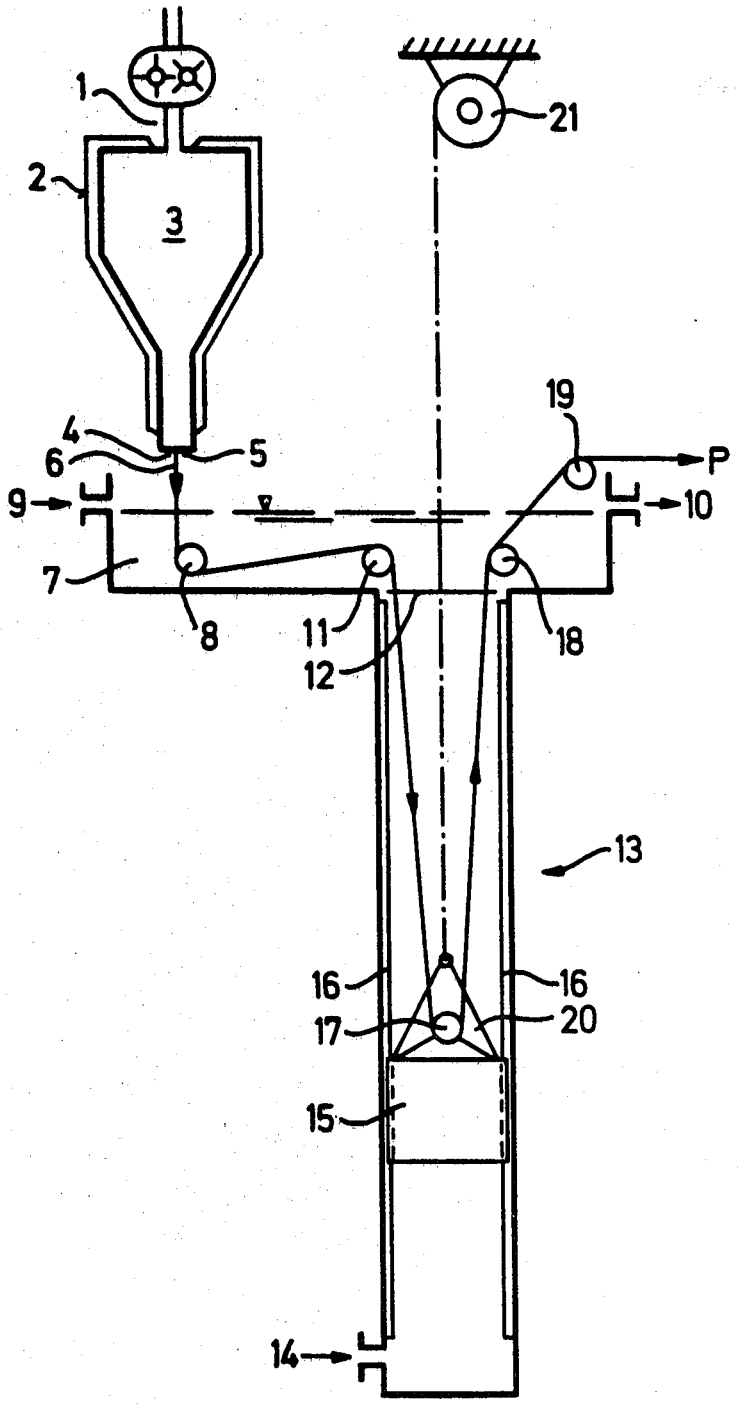
1
2
3
4
5
6
7
8
9
10
11
12
13
14
15
16
16
17
18
19
20
21
P

PROCESS AND APPARATUS FOR THE PRODUCTION OF PLASTIC STRANDS

The present invention relates to a process and apparatus for the production of strands of synthetic materials, in which the viscous melt flows through die orifices, and the resulting individual strands, to be regarded as filaments, are led in counter-current to a stream of cooling water, in order to solidify them, and are then led to a further processing stage.

In the prior art, a melt of synthetic materials such as nylon, polyester, polyethylene terephthalate, polybutylene terephthalate or polystyrene is passed, via orifices of a die plate, into a bath of cooling water through which the individual strands of melt are led, in an essentially horizontal cooling path, until they reach the desired strength. The length of the cooling path is in the main chosen in accordance with four parameters: the diameter of the individual melt strands, their flow rate, the additives in the melt, and the cooling water temperature. The cooling troughs conventionally used for this purpose have, in industrial practice, lengths of from 10 to 15 m. These not only require a great deal of space but also have the disadvantage that the length of the cooling path cannot be varied to allow for changing parameters.

It is an object of the present invention to provide a process and apparatus for the production of strands of synthetic materials, wherein the length of the cooling path is adjustable to match changing parameters. It is a further object substantially to reduce the length of the trough compared to that of conventional cooling troughs.

We have found that this object is achieved by a process in which the viscous melt flows through die orifices, and the resulting individual strands, to be regarded as filaments, are led in counter-current to a stream of cooling water, in order to solidify them, and are then led to a further processing stage, wherein the individual melt strands are first led along a short, essentially horizontal path for minimum solidification and thereafter are led in an essentially vertical loop of variable length through a cooling water bath for complete solidification.

The invention further relates to an apparatus comprising a vessel, which has a heating jacket and a melt feed and is closed at the bottom by a plate with die orifices, and a short trough, connected below the die orifices, with guide rollers for leading the melt strands into and out of the trough, the trough being provided with a cooling water inlet at the die plate end and an outlet at the opposite end, wherein the bottom of the trough has, at a distance from the die plate adequate for initial surface solidification of the melt strands, an orifice which merges into an essentially vertical pipe, closed at its lower end, in which a direction-reversing roller, attached to a holding and guiding element, is located in a height-adjustable manner.

Further details and features of the invention are given in the description which now follows and which relates to the drawing, wherein an apparatus for carrying out the process is shown diagrammatically.

The melt of synthetic material is passed, by means of a pump, for example a gear pump, through an inlet 1 into a vessel 3 equipped with a heating jacket 2, and is then forced through the orifices 4 of a die plate 5, so that individual melt strands 6, which may be regarded as filaments, are produced. These then pass into a trough 7 wherein, for initial chilling, they are led, by means of a first guide roller 8, in counter-current to a stream of cooling water between an inlet 9 and an outlet 10, at a depth which is up to 300 times their diameter, if the speed of travel of the melt strands is from 50 to 150 meters per minute, the length of this essentially horizontal cooling path is from 500 to 1,500 times the diameter of an indivudual strand of melt.

After the melt strands have been sufficiently chilled, over this cooling zone, that their surface strength suffices to withstand the weight of the vertically suspended melt strand plus a tensile force P, they are led, by means of a second guide roller 11, via an orifice 12 in the bottom of the trough into an adjoining essentially vertical pipe 13, whose length, in industrial operation, is from about 4 to 6 times the distance between the center of the orifice in the trough bottom and the die plate. In the pipe, which is closed at its bottom end and which also has an inlet 14 for cooling water, a hollow cylinder 15 is slidably located on rails 16 and serves as a holding and guiding element for a direction-reversing roller 17 located at its upper end.

Around this direction-reversing roller, the individual melt strands travel in a loop, having a length of from 2,000 to 10,000 times the diameter of the strands, back to the trough 7, from where they are led, via the guide rollers 18 and 19, out of the cooling water bath, in the form of completely solidified filaments or strands, to a further processing stage.

The hollow cylinder 15, with direction-reversing roller 17, is slidable, by means of a lifting hoist 21 engaging on a stirrup 20 of the hollow cylinder, along the axis of the pipe, so that the length of the loop in the pipe 13 and accordingly the length of the cooling path are adjustable. This adjustability, to suit the particular process parameters, permits selection of an optimum length of cooling path for the melt strands. This is important, since the temperature of the solidified melt filaments, on further processing, determines the quality of the product; for example, it determines the quality of the cut if the strands are converted to granules. A filament or strand which has been excessively cooled often gives, because of its toughness, projecting tails which produce undesirable dust on subsequent pneumatic conveying. Moreover, the energy consumption for chopping the strands, and the wear of the cutters, are increased. On the other hand, if the strands are inadequately cooled, the individual granules may adhere to one another and form curved chains, which can block the feed line.

We claim:

1. A process for the production of strands of synthetic materials, in which the viscous melt flows through die orifices, and the resulting individual strands, to be regarded as filaments, are led in counter-current to a stream of cooling water, in order to solidify them, and are then led to a further processing stage, wherein the individual melt strands are first led along a short, essentially horizontal path for minimum solidification and thereafter are led in an essentially vertical loop of variable length through a cooling water bath for complete solidification.

2. A process as claimed in claim 1, wherein the individual melt strands are led through a bath of cooling water, at a speed of travel of from 50 to 150 meters per minute, essentially horizontally over a length of from 500 to 1,500 times their diameter and thereafter essentially vertically in a loop having a length of from 2,000 to 10,000 times their diameter.

3. Apparatus for the production of strands of synthetic materials, comprising a vessel, which has a heating jacket and a melt feed, and is closed at the bottom by a plate with die orifices, and a short trough, connected below the die orifices, with guide rollers for leading the melt strands into and out of the trough, the trough being provided with a cooling water inlet at the die plate end and an outlet at the opposite end, wherein the bottom of the trough has, at a distance from the die plate adequate for initial surface solidification of the melt strands, an orifice which merges into an essentially vertical pipe, closed at its lower end, in which a direction-reversing roller, attached to a holding and guiding element, is located in a height-adjustable manner.

4. Apparatus as claimed in claim 3, wherein the length of the pipe is equal to from 4 to 6 times the distance between the center point of the orifice of the trough bottom and the die plate.

5. Apparatus as claimed in claim 3, wherein the holding and guiding element is a hollow cylinder sliding on rails, the direction-reversing roller being held at the upper end of the element, while a device for adjusting its height engages above it.

6. Apparatus as claimed in claim 3, wherein the device for the height adjustment of the holding and guiding element is a lifting hoist.

7. Apparatus as claimed in claim 3, wherein the pipe is equipped with a cooling water inlet at its bottom end.

* * * * *